United States Patent [19]

Poterala

[11] Patent Number: 4,817,254

[45] Date of Patent: Apr. 4, 1989

[54] TENTER ENTRY FEED SYSTEM AND METHOD

[76] Inventor: Robert J. Poterala, Rte. 15, Rocky Pointe Way, Greenville, S.C. 29615

[21] Appl. No.: 855,467

[22] Filed: Apr. 24, 1986

[51] Int. Cl.[4] ..... D06C 3/02; D06H 3/12

[52] U.S. Cl. ..... 26/51.3; 26/76; 26/86; 26/96

[58] Field of Search ..... 26/76, 86, 96, 51.3, 26/51.4, 51.5

[56] References Cited

U.S. PATENT DOCUMENTS

| | | | |
|---|---|---|---|
| 1,673,253 | 6/1928 | Krantz | 26/86 |
| 2,145,044 | 1/1939 | Dungler | 26/86 X |
| 2,310,245 | 2/1943 | Learnard et al. | 26/86 |
| 2,434,111 | 1/1948 | Hawley, Jr. et al. | 26/86 X |
| 2,482,270 | 9/1949 | Grundy | 26/86 X |
| 3,150,432 | 9/1964 | McCreary | 26/76 |

FOREIGN PATENT DOCUMENTS

| | | | |
|---|---|---|---|
| 134551 | 3/1979 | German Democratic Rep. | 26/96 |
| 354110 | 8/1931 | United Kingdom | 26/86 |
| 420769 | 12/1934 | United Kingdom | 26/86 |
| 510838 | 8/1939 | United Kingdom | 26/86 |
| 653306 | 5/1951 | United Kingdom | 26/86 |

*Primary Examiner*—Robert R. Mackey
*Attorney, Agent, or Firm*—Cort Flint

[57] ABSTRACT

A tenter entry feed assembly and method is disclosed for a tenter which includes a pair of spaced entry feed assemblies (A, 25, 27). Each entry feed assembly includes a parallel pinning rail section (B), an adjacent elongated fabric conveyor (C, 40), and an elongated contoured feedplate (55) adjacent to each conveyor. Also carried by each entry feed assembly is a sprocket wheel (46) at least one of which is keyed for rotation with a shaft (48). The fabric conveyors (C) and contoured feed plates (55) extend next to a main feed roll (54) of the entry system. In this manner, a pinning point (29) is defined which is very close to the main feed roll and the distance between the feed roll and the pinning point is substantially reduced so that control over the fabric may be had positively by conveyor (40) in the zone. Pinning of the selvages of the fabric (F) occurs in a natural relaxed state generally without tension. An output (88) of shaft (48) is connected to a phase adjusting drive (94). Phase adjusting drive (94) may be utilized to drive conveyors (C) in a 1:1 relationship with the tenter chain or in an overfeed or underfeed relationship. First and second phase adjusting drives (132, 150) are provided for adjusting the speed of conveyors (C) independently of one another in order to take out any bias or other distortion markings in the fabric. Direct mechanical connection is provided between a drive (52) of the tenter and the phase adjusting drives of conveyor (C) so that fabric is fed for pinning in direct response to start up of the tenter.

26 Claims, 6 Drawing Sheets

Fig. 6.
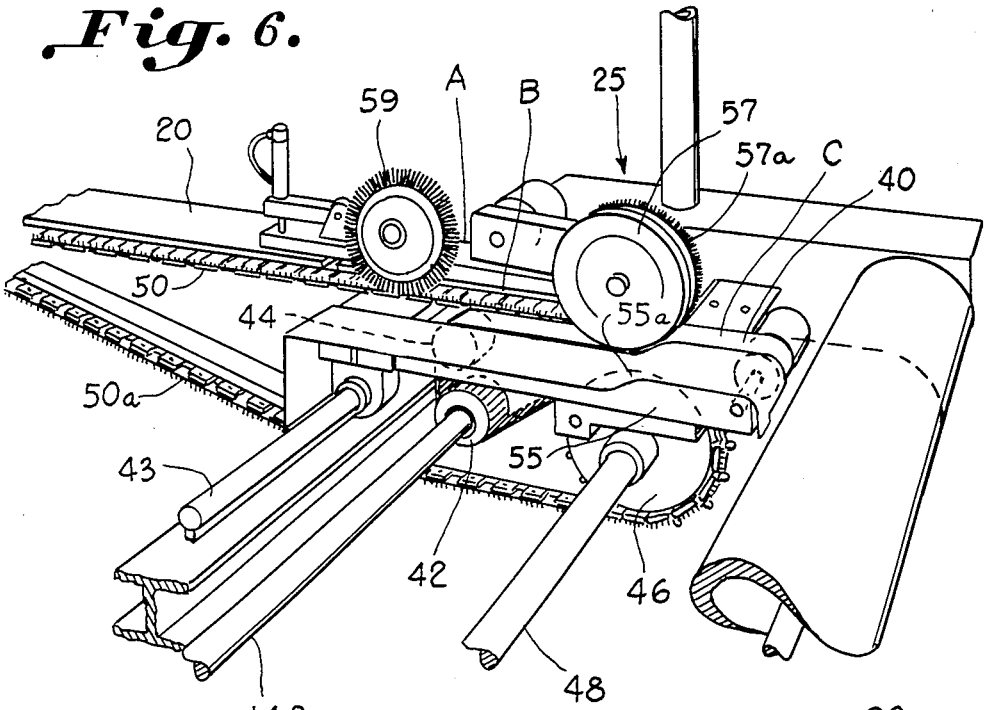
Fig. 6A.
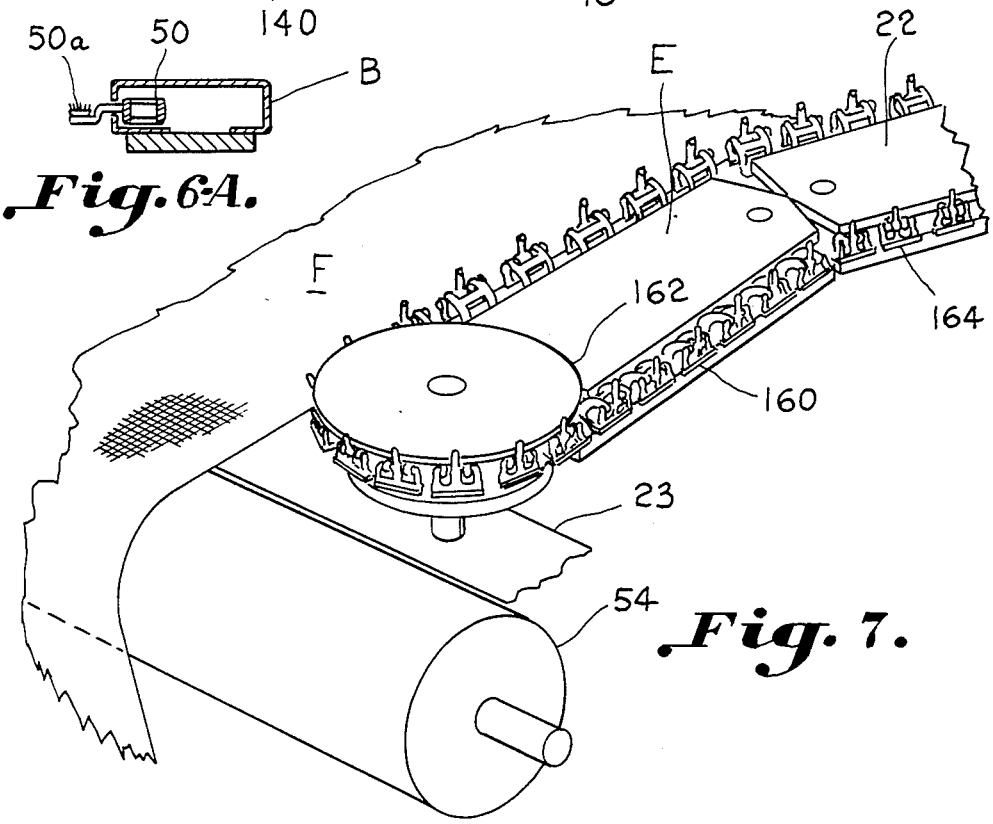
Fig. 7.

TENTER ENTRY FEED SYSTEM AND METHOD

BACKGROUND OF THE INVENTION

The invention relates to the entry feed end of a tenter and the feeding of the fabric selvages to be pinned or clipped to the traveling chains carried by tenter rails. Heretofore, the fabric at the entry end has been placed upon angularly oriented tenter rails which pivot to follow the fabric and convey it on divergent rails which stretch the fabric.

In 90% of the applications, the tenter entry rails pivot either to diverge or converge in accommodating fabric whose width is different than the desired width of the fabric and the tenter. In this case, the selvages of the fabric are pinned onto pins of the tenter chains in a nonparallel condition. This results in scalloping of the fabric at the selvages and skewing of the fabric creating bias lines. The filling yarns are subjected to nonuniform tensions across the fabric creating lines in the fabric.

In other applications of the conventional tenters, the centerline of the fabric is offset from the centerline of the tenter and the tenter entry rails are pivoted parallel to shift the fabric over to the centerline of the tenter. In this situation, the selvages may be pinned or clipped in a more parallel fashion but still at an angle to the entry of the fabric and to the center line of the tenter. This also causes problems in selvage and fabric distortion.

Typical of the above described prior art, are U.S. Pat. Nos. 3,430,301 and 3,147,532.

U.S. Pat. No. 2,673,384 teaches to pin the fabric initially nonparallel and thereafter pass the fabric through parallel sections. However, the initial nonparallel pinning may result in fabric distortion which is continued on throughout the parallel section and onto the main tenter rails.

U.S. Pat. No. 3,150,432 discloses a tenter having pinning rails which may be parallel, but there is little or no positive control of the fabric in the pinning section to ensure straight and accurate pinning. Furthermore, the rails in the pinning section are movable in the direction of fabric travel causing possible stretching during pinning. Tension on the fabric at the pinning area affect accurate control and pinning of the fabric.

U.S. Pat. No. 3,670,375 discloses conventional angular tenter entry rails. A belt is utilized to support and transport the center of the fabric onto tenter rails.

In the prior art overfeed devices, typlified by U.S. Pat. No. 3,147,532, it has been typical to drive overfeed devices at opposing edges of the fabric independently of one another to correct the skew or bias of the fabric. The overfeed drive also serves as a final means to control the per unit weight of the fabric in order to meet the fabric specifications. If it is desired to reduce the weight per square yard of the fabric, then underfeeding is employed. If it is desired to increase the weight of the fabric per square yard in order to meet specifications, then overfeeding may be employed. However, it is desired that the underfeeding or overfeeding be kept within that range only necessary to meet fabric specifications and not to overcompensate. The typical overfeed drive employs a pair of wheels having a nip between which the selvages are fed. Thus, only a point line contact of fabric is had providing little positive control.

In the prior art overdrive systems, the systems have not afforded enough accuracy to control the weight of the fabric as desired. U.S. Pat. Nos. 2,145,044 and 3,604,078 are typical. It has also been known to drive the tenter chains themselves at different speeds in order to correct the skew of the fabric such as in U.S. Pat. Nos. 4,346,621 and 3,839,767.

Another problem in the prior tenter frames has been that of the necessity of having clearance between the ends of the entry rail and the feed roll due to the angular or longitudinal movement of the entry rails. This clearance is needed to allow for the entry rails to pivot either to a divergent or a convergent configuration. To allow the rail to swing in an arc, a sufficient clearance is needed between the end of the rail and the feed roll. However, this angular clearance space creates added distance over which control of the fabric is made difficult and the selvages wander.

Further, due to the temperature differential between ambient temperature and the elevated oven temperatures, considerable thermal expansion of the tenter rails occur resulting in elongation. In order to accommodate the external elongation, it has been necessary to provide additional clearance between the ends of the entry rails and the feed roll. This also increases the uncontrollable space over which the fabric spans and travels from the feed roll to the point of pinning. In this space, the edges of the fabric may tend to wander and lose straightness. The result is that the edges are not pinned on straight to the tenter chains. Numerous devices have been added at the edges of the fabric over this span between the feed roll and pinning point in order to keep the edges straight, requiring additional expense and effort. These devices are commonly referred to as edge uncurlers as shown in U.S. Pat. No. 3,150,432.

The typical overfeed device now found on tenters includes feed rollers which are driven by electric motors. In the normal overfeed or underfeed range of 10%, however, these electric drive motors are susceptible to as much as 50% error in the low speed range. This is because the motors which typically have a 5:1 drive ratio and a ½% to 1% speed accuracy over the full range of the motor, results in only a 5% accuracy in the low range of the motor. When it is necessary to underfeed, the electric motor which directly drives the feed roller cannot be driven in a reverse direction, but only slowed down. Thus a true underfeed is not possible but only a drag on the motor is possible due to its freewheeling nature and drag obtained through the friction of the mechanical resistance in the motor gearing. In this case, no accurate control over the rotation of the wheel is actually imparted but rather just resistance to friction slowing the wheel down.

Moreover, in the conventional feed arrangement, a separate electric motor is provided for each side of the overfeed assembly and a separate motor is provided for driving the tenter chain. Upon startup, there is a time lag between the startup of the overfeed motors and the chain drive motor. This can cause creation of a section in the fabric which is either stretched or tremendously overfed compared to the condition of the fabric on the chain. This occurs each time that the fabric is started and stopped. Thus, it can be seen that accurate control of the prior art overfeed systems cannot be had. In particular, no precise control over the underfeeding can be had because no exact control of the negative rotation of the overfeed wheel can be had through direct control of an electric motor.

Moreover, all of the above discrepancies and problems in the prior art require more attention be given to the operation of the tenter requiring increased personnel to be in attendance during operation.

In the prior art overfeed devices, another problem occurs in providing positive control of the fabric. This is, the feed roll of the overfeed drive contacts the fabric at a point of contact and only over a very short distance. This affords only very short gripping and control of the fabric.

Accordingly, an object of the invention is to provide a tenter which may be operated in a more accurate and trouble free manner while accurate control of the weight of the cloth with reduced personnel may be had.

Another object of the invention is to provide a more continuous and positive control over the fabric as it is conveyed or transported through an entry tenter system for pinning.

Another object is to provide apparatus and method for pinning selvages of fabric straight and parallel onto pinning rail sections in a relaxed laid-out state generally without tension, but with positive fabric control.

Another object of the invention is to provide a tenter entry system in which the edges of the fabric are laid on the tenter clips or pins in a straight configuration and a relaxed state so that more even attachment of the fabric occurs in a manner that skew, bias, and other fabric distortions are minimized.

Another object of the invention is to provide a tenter entry feed system wherein more accurate control of the overfeed assembly may be had in order to more accurately control the weight of the fabric produced thorugh the tenter to meet fabric weight specifications.

Another object of the invention is to provide an overfeed drive for the entry end of a tenter wherein underfeed may be controlled in an accurate manner and positive control of the amount of speed subtracted from the overfeed drive may be had.

Yet another object of the invention is to provide an entry feed system for a tenter in which clearance between the main feed roll which feeds the fabric to the entry feed system and the ends of the pinning rails is reduced to a minimum so that control over the fabric is maintained between the feed roll and the point of pinning.

Still another object of the invention is to provide a means for transporting fabric continuously through the pinning rail sections of an entry in a manner that fabric is grasped and conveyed adjacent the feed roll and continued through the pinning point in a positively controlled manner.

SUMMARY OF THE INVENTION

The above objectives are accomplished according the to present invention by providing an entry feed system having a pair of parallel pinning rail sections included as part of the entry rails. The parallel sections are fixed except to move parallel in response to the width of the fabric. Fabric conveyors transport the fabric from the main feed roll continuously through the pinning rail sections in a manner that the fabric is laid on the pins in a relaxed state without tension and in a straight manner without distortion of the fabric. The edges are started out on the clips or pins of the tenter chains in a straight manner and are maintained and are continuously pinned in a straight manner on the parallel rail sections of the entry rails. In particular, an elongated transport belt is used as an overfeed and underfeed conveyor which transports the fabric over the length of the parallel rail sections. The conveyor belt extends considerably behind the point of pinning, and picks the fabric off directly of the main feed roll so that control of the fabric is had to the pinning point, and the edges are not allowed to wander or beomce unstraight. The straight pinning produces uniform stretch in the filling yarns whereby a higher quality fabric can be had. Positive control of the conveyor belts is had in both the underfeed and overfeed direction and in synchronization with the tenter chain. The time lag between tenter chain drive and overfeed drive at startup is eliminated by direct mechanical interconnection thus reducing stretching and excessive supply of fabric at the entry feed during startup. Minimum clearance between the main feed roll and the ends of the entry rails is had by fixing the pinning rail sections and by segmenting the tenter rails along the entire length of the tenter. The pinning rail sections undergo no movement at the entry end decreasing the space and span of fabric between the main feed roll and point of pinning. Phase adjusting drives are provided for adjusting the speed of the belt conveyors together or individually to meet fabric weight specifications and correct for fabric distortion. Normally, however, the drive system, with the phase adjusting drive not actuated, will drive the conveyors in precise synchronization with the tenter chains due to sizing of the drive elements.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 2A is a partial top plan view of FIG. 2 enlarged;

FIG. 3A is an enlarged plan view illustrating the problems of pinning fabric in a distorted manner on conventional tenter entry systems.

FIG. 6 is a perspective view illustrating an entry feed assembly according to the invention;

FIG. 6A is a partial section view of a pinning rail section of FIG. 6; and FIG. 7 is a perspective view illustrating an entry end for a tenter according to the invention wherein clips are employed instead of pins.

DESCRIPTION OF A PREFERRED EMBODIMENT

Figure 1:
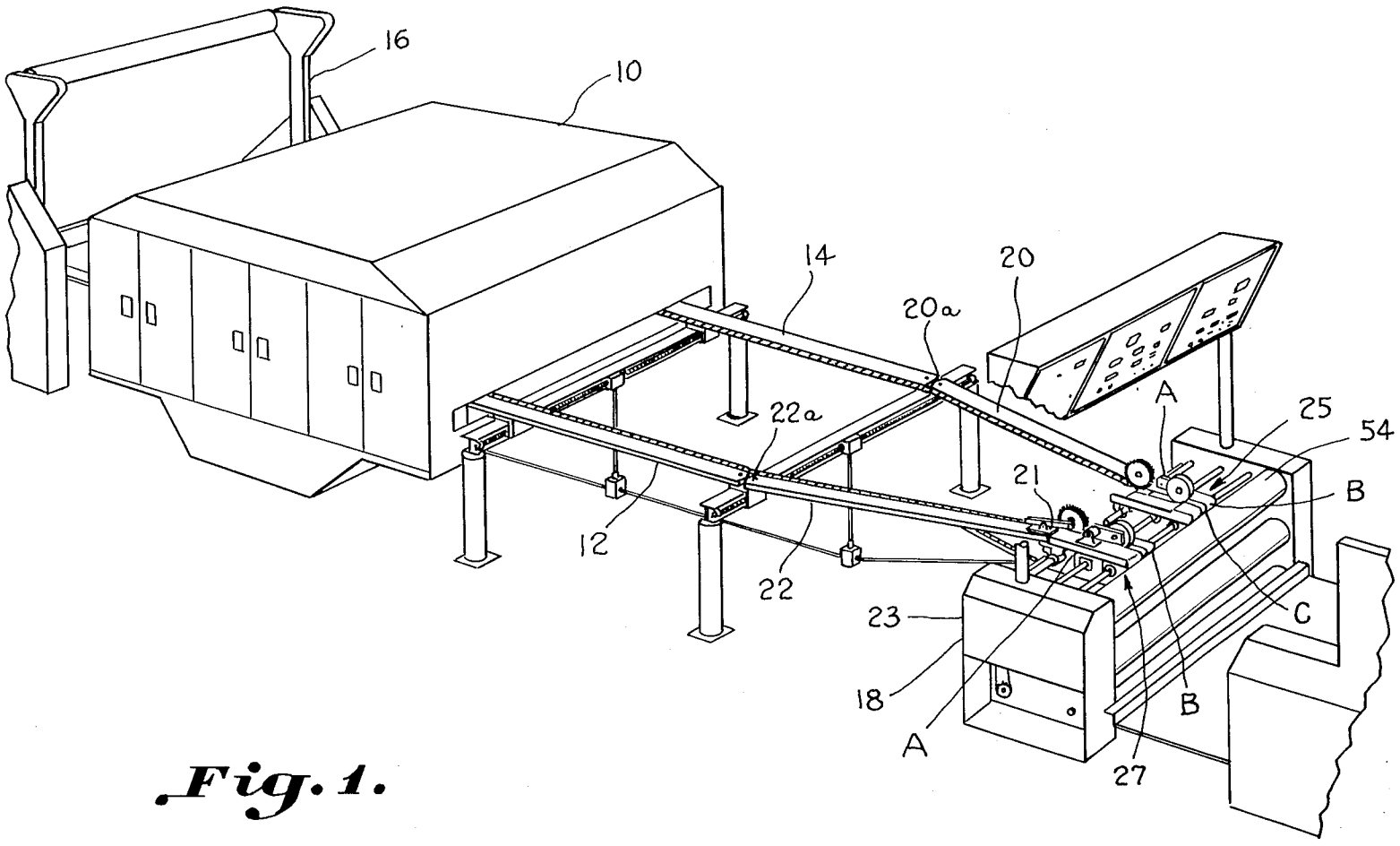
FIG. 1 is a perspective view illustrating a tenter incorporating an entry feed system constructed in accordance with the present invention.

Referring now in more detail to the drawings, as can best be seen in FIG. 1, a tenter, or tenter range, is illustrated as including an oven 10 and a pair of spaced tenter rails 12 and 14 which extend through the oven to an exit end 16 of the range from an entry end 18 of the tenter.

Entry end 18 of the tenter forms the subject matter of the present invention and thus the remainder of the tenter will not be described in detail since it is not necessary for an understanding of the present invention.

Accordingly, referring in more detail to FIG. 1, tenter entry end 18 includes a pair of entry rails 20 and 22 which are pivoted at 20*a* and 22*a*. Tenter rails 12 and 14 are generally parallel and are fed by the entry rails 20 and 22. There are a pair of entry feed assemblies A carried at the entry end of the tenter which are identical and which move horizontally in a sliding motion relative to each other on frame 23 to follow the edge of the fabric as is customary with tenters by utilizing a feeler gauge to sense the edges of the fabric.

There is a first entry feed assembly designated generally at 25 on one side of frame 23 and a second entry feed assembly designated generally at 27 on the opposite side of frame 23.

Each entry feed assembly includes a fixed parallel pinning rail section B which forms part of the entry rails.

Figure 2:
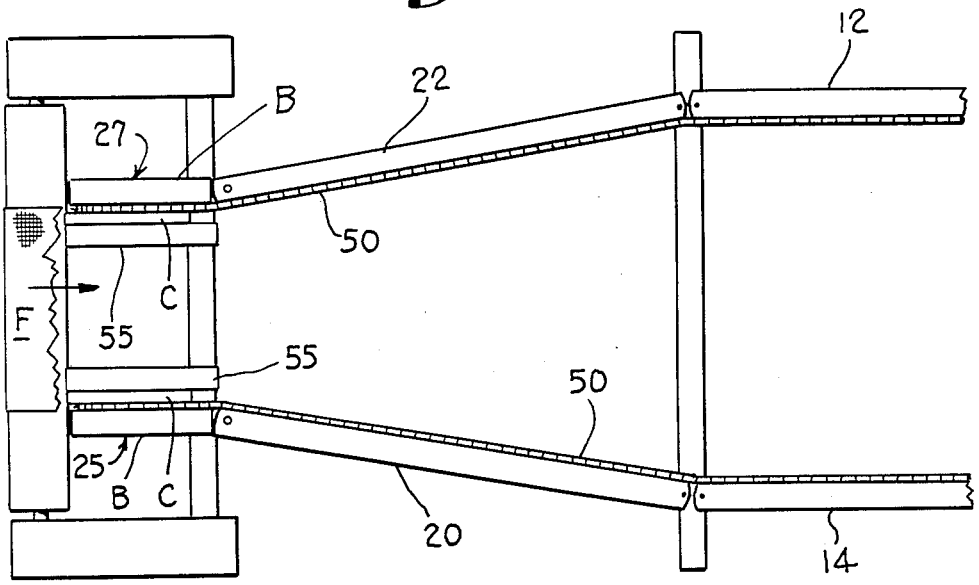
FIG. 2 is a top plan view of an entry system for a tenter according to the invention.
Figure 2:
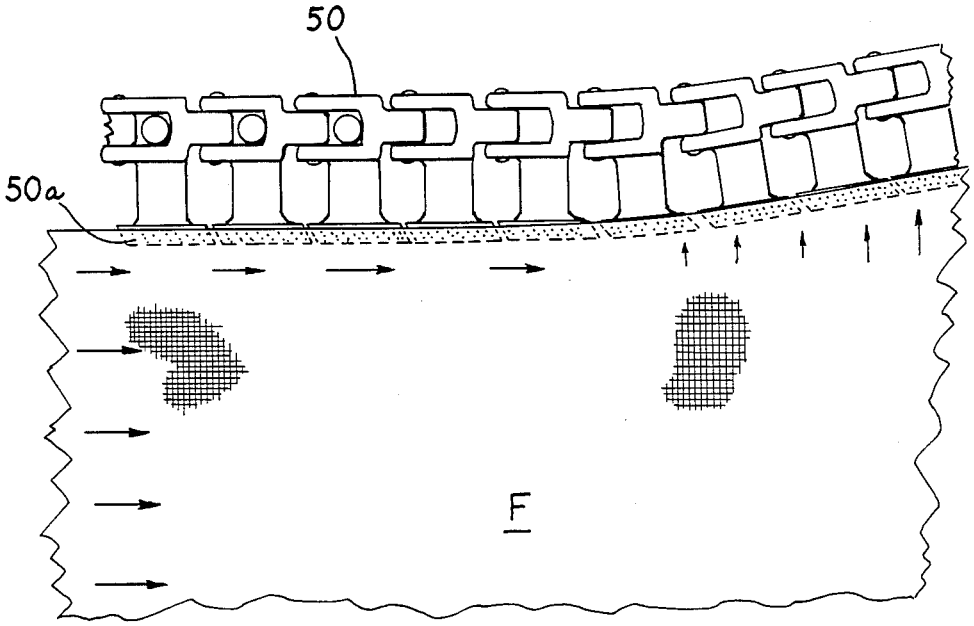
Figure 3:
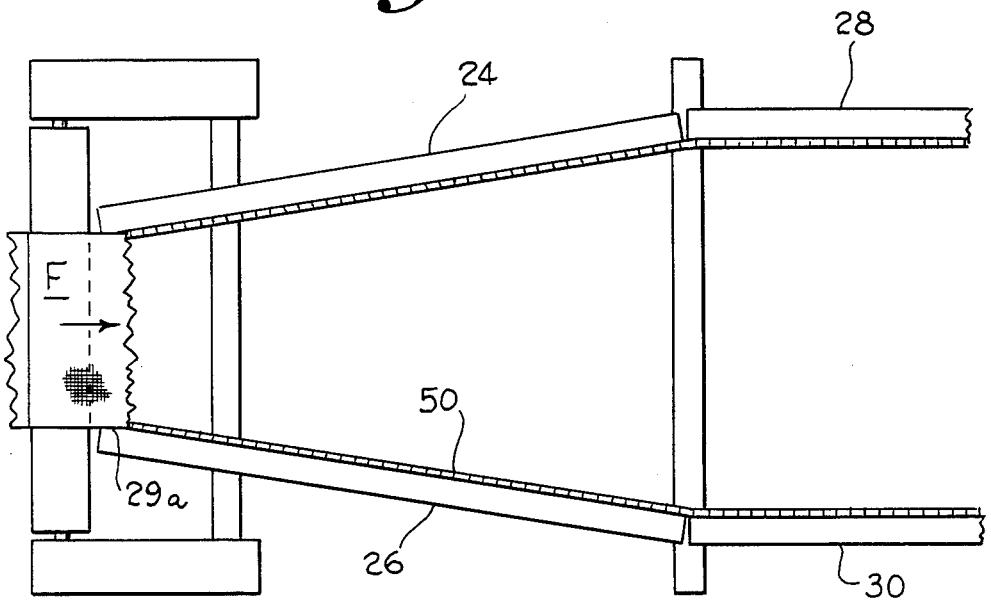
FIG. 3 is a top plan view of a prior art entry end of a tenter.
Figure 3:
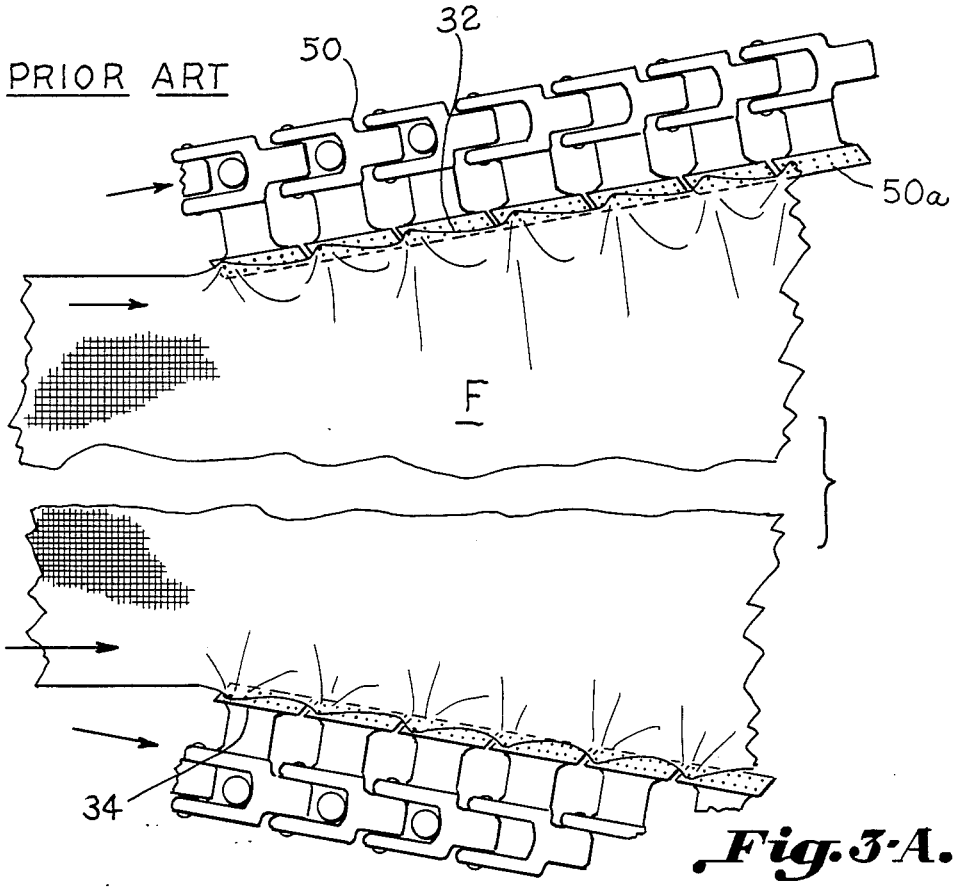

As can best be seen in FIG. 2, the parallel pinning rail sections B are slideably carried in parallel relationship with the entry feed assemblies A and feed the fabric onto the entry rails 20 and 22 which are shown in a divergent configuration so as to stretch the fabric prior to entering the oven.

Referring now to the prior art Figures of 3 and 3A, entry rails are illustrated at 24 and 26 which diverge from the pinning point designated at 29*a*. This is the configuration of the conventional tenter rails in most applications. In this application, the width of the fabric between the main tenter rails 28 and 30 and the entry width of the fabric, as shown, is such that the fabric is to be stretched. The divergent entry rails 24 and 26 provide a pinning and transition of the fabric to the stretched configuration between rails 28 and 30. However, the problem arises that not only are entry rails 24 and 26 diverging, but the fabric may be overfed onto the pins at the same time. This results in the edges of the fabric 32 and 34 being stretched nonuniformly producing nonuniform stretching of the filling yarns extending crosswise in the fabric. This causes the appearance of the filling yarns to take on different appearances depending on the amount of stretch produced in the filling yarns. Moreover, the edges of the fabric become pinned in a scalloped manner and the scalloped edge often must be trimmed off as waste. Further, the nonuniform stretching of the fabric in overfeeding causes skewing and biasing as well as other distortions in the fabric.

Figure 5:
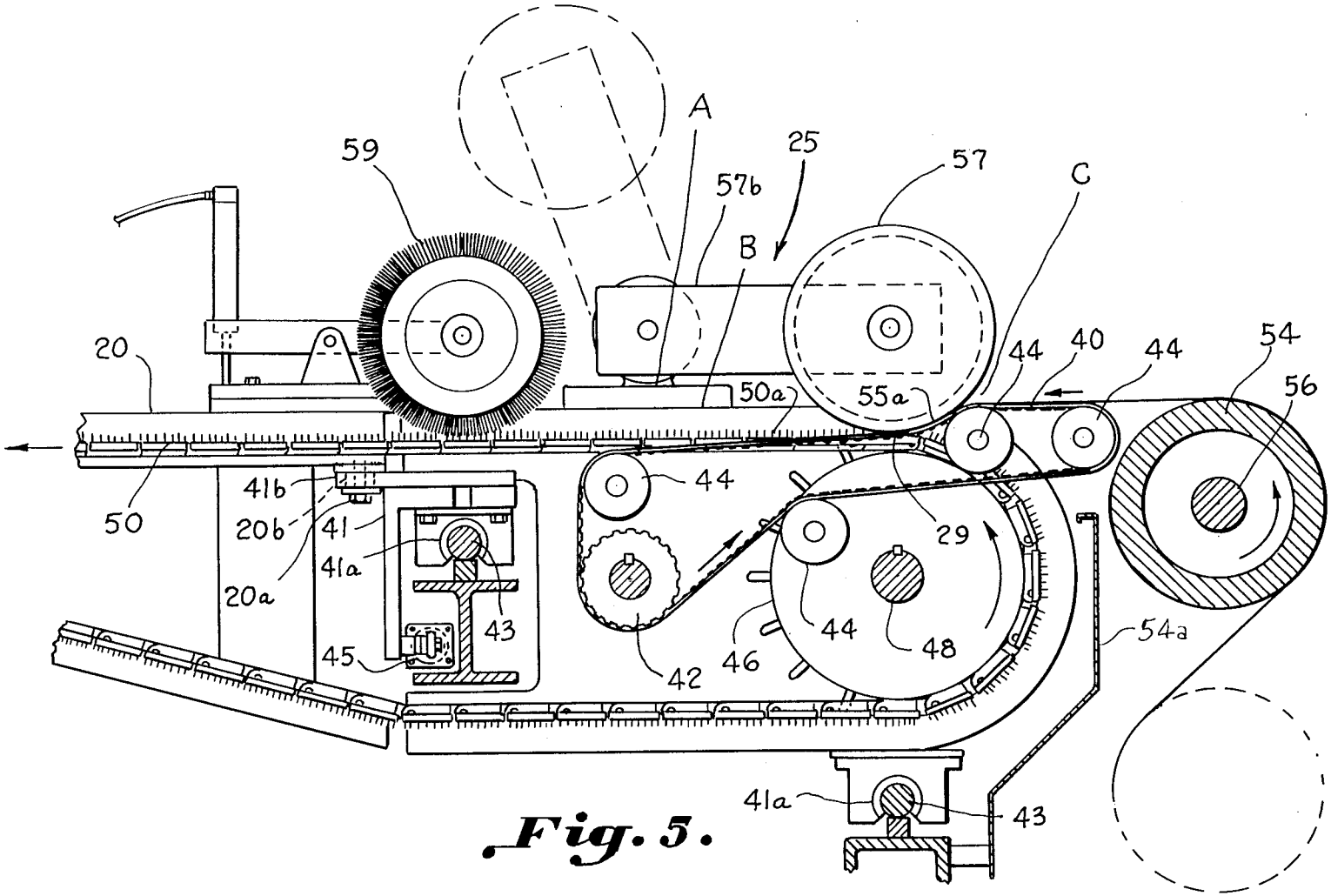
FIG. 5 is a partial section and elevation of a entry feed assembly having parallel pinning rail sections according to the invention.

In accordance with the present invention, as can best be seen in FIGS. 2, 2A, and 5, the fabric is pinned on the parallel pinning rail sections B in a straight configuration whereby the scalloping of the edges in a relaxed state and the nonuniform stretching of the filling yarn is eliminated. Furthermore, in accordance with the present invention each feed assembly A includes a fabric conveyor means C in the form of an elongated conveyor belt 40 which extends well behind the pinning point 29 to transport the fabric in a laid-out, relaxed manner without tension to the pinning point. In this manner, the fabric selvages, having already been laid out in a straight and relaxed configuration on conveyors C, is brought to the pinning point in a configuration that uniform straight pinning of the fabric onto the pins or clips may be had. Since the edges of the fabric are clipped or pinned straight, at this pinning point the fabric continues to be transported through the pinning section in a straight manner prior to being conveyed by the entry rails 20 and 22 in an angular configuration. By this time the fabric has already been held firmly either by clips or pins by the tenter chains and is thereafter maintained in a nondistorted and uniformly stretched manner.

As can best be seen in FIGS. 5 and 6, each assembly A includes a carriage 41 having slide bearings 41a which slides on rods 43 affixed to beam structure of frame 23. Hydraulic cylinders 45 move each carriage 41 back and forth to follow the opposing fabric selvages in response to edge sensors (not shown) all in a conventional manner. Carried by carriage 41 is a drive gear belt pulley 42 and a series of idler rolls 44 about which elongated conveyor belt 40 is driven. There is an idler sprocket wheel 46 which is keyed on a shaft 48 rotatably journeled on frame 23 of the entry system about which the tenter chain 50 travels. Carriage 41 slides along shaft 48 while carrying sprocket 46. The tenter chain is driven by a drive motor 52 at the exit end of the tenter. There is a main feed roll 54 which rotates on shaft 56 and is carried by frame 23.

Referring now to FIGS. 5 and 6, tenter pin chain 50 is illustrated as traveling about idler sprocket 46 and the tenter chain is guided and carried by the parallel pinning rail section B (FIG. 6A). Rail section B is affixed to carriage B, such as at carriage plate 41*b*, in a manner that it is rigid therewith to move in parallel transverse to the fabric conveyance and with the rails ends fixed. Entry rail 20 is pivotally attached at 20*a* to carriage plate 41*b*.

Carried adjacent the tenter chain 50 is elongated traveling conveyor belt 40 which extends rearwardly to next adjacent main feed roll 54. A guard plate 54a is carried in a gap between main feed roll 54 and in chain sprocket 46 for protecting the fabric from soil in view of the close proximity of the main feed roll and chain sprocket. Carried by carriage 41 adjacent the conveyor belt 40 is a contoured feed means in the form of a contoured feed plate 55. Fabric is placed on pins 50*a* of tenter chain 50 as the pins are traveling upwards whereby fabric and pins mate at pinning point 29. Feed plate 55 supports the fabric to the side of conveyor belt 40 and reduces lateral slippage of the fabric, particularly from the nip of wheel 57 and conveyor 40. Due to tension of belt 40 and its support on carriage 41, there is little or no downward force on the fabric by wheel 57.

There is an overfeed wheel 57 directly above conveyor belt 40 and adjacent contoured feed plate 55 and pinning point 29. Wheel 57 is an idler wheel and has a pinning brush 57*a* concentrically mounted therewith. Wheel 57 and brush 57*a* are carried on a pivoted bar 57*b* and may be weighted by weight or fluid pressure (i.e. an air cylinder) to exert a desired force on the fabric. There is a second pinning brush 59 downstream in the pinning zone which may be biased downwardly to ensure the fabric is pushed firmly on the pins 50*a*. The weight of wheel 57 against conveyor belt 40 conforms the surface of belt 40 to that of wheel 57. Feed plate 55 has a downwardly curved contour 55*a* over which fabric travels downwardly as it follows deformed conveyor 40.

As can best be seen in FIG. 5, there is a minimum clearance between the end of traveling tenter pin chain 50 and main feed roll 54. The parallel pinning rail sections B move parallel to each other, but are fixed and do not move longitudinally in the direction of fabric travel.

The ends of parallel pinning rail sections B move in a straight motion transverse to main feed roll 54, and not in an arcuate motion. Accordingly, the entire entry feed system may be placed in close proximity to the main feed roll 54. In particular, elongated conveyor belt 40 is illustrated as extending just slightly out of contact with main feed roll 54. Likewise, contoured feed plate 55 extends along side conveyor 40. In this manner, fabric coming off of main feed roll 54 is placed directly onto the elongated conveyor 40 and feed plate 55 in a laid-out, relaxed, and generally tension-free state. The distance and span of the fabric from the takeoff point on feed roll 54 and the pinning point 29 is very short. There is positive control over the fabric spanning between feed roll 54 and pinning pint 29 by means of the conveyor 40 which positively controls the fabric selvages laid thereupon. Further, the extention of contoured feed plate 55 assists in the control of fabric over this span.

There is a sliding pivot joint 20*a* between entry rail 22 which allows for the articulated motion of entry rail 20 on carriage 41. Pivot joint 20*a* is slotted and 20*b* allows for slight articulation of entry rail 20 relative to the fixed pinning rail sections. There is no longitudinal displacement of the parallel pinning rail sections and the pinning point 29 remains constant throughout tenter operation and throughout articulation of the angular entry rails. No stretching occurs in the fabric due to the fact that the tenter chain is fixed at the pinning point and does not change its position.

While the above description of the entry feed assemblies A have been made in reference to entry feed assembly 25, it is to be understood that the entry feed assembly 27 on the opposing side of frame 23 would be identical. For these purposes, entry feed assembly 25 may be designated as a first entry feed assembly, the elongated conveyor means C may be designated as a first conveyor means, and the feed plate 55 may be designated as a first feed plate means. Likewise, in respect to entry feed assembly 27 on the opposing side of the frame, pinning rail section B may be designated as a second pinning rail section parallel to the first pinning rail section. Elongated conveyor belt 40 may be designated as a second elongated conveyor belt, and feed plate 55 may be designated as a second feed plate.

Figure 4:
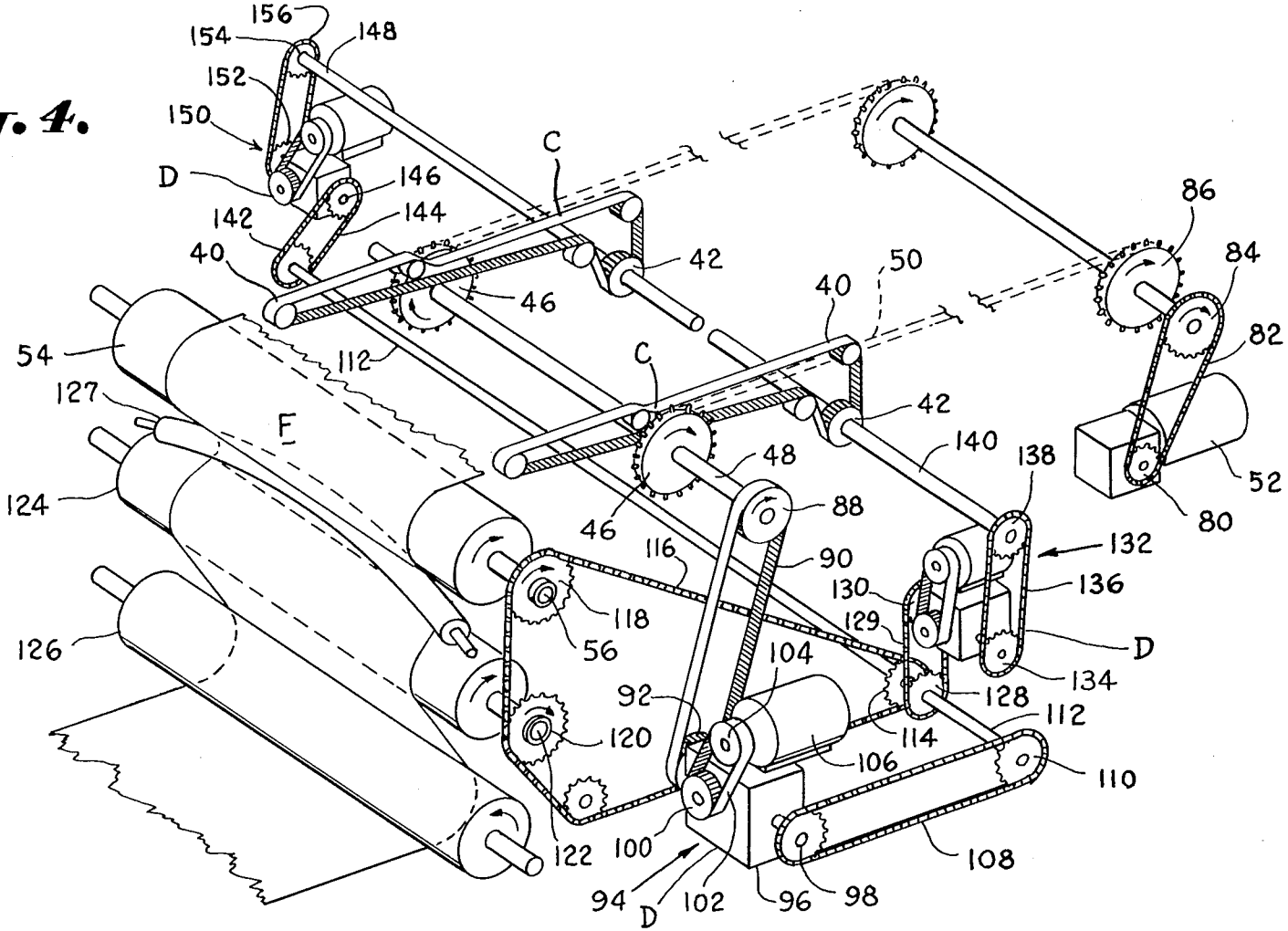
FIG. 4 is a parts perspective view illustrating a phase adjusting drive for positively controlling both underfeed and overfeed at the entry end of a tenter in synchronization with the tenter drive.

Referring now to FIG. 4, a phase adjusting drive means D for the conveyor 40 will now be described which adjusts the speed of conveyors 40. The tenter speed is determined by the speed of tenter chains 50 which are driven by a drive motor 52 through a drive gear 80, chain drive 82, drive sprocket 84, and main drive sprocket 86. In return, the tenter chain 50 drives the sprocket wheel 46 at the entry end. Shaft 48, affixed for rotation to at least one sprocket wheel 46, fixably carries a gear belt pulley 88 which drives a belt 90 which drives a main input in the form of an input drive gear pulley 92, of a main phase adjusting drive means D, designated generally as 94. Phase adjusting drive means 94 includes a planetary gear box 96. There is an input shaft, not shown, affixed to gear 92 and an output shaft at 98 providing a main output. The phase adjusting drive means D may be a conventional instant phase changer and speed reducer manufactured by A. Fisher Tool and Machine Works, Chicago, Ill., Model G2000. The planetary gear box provides straight power input from 92 to 98 when the planetary gear is set. Pulley 100 changes the gear setting by means of belt 102 and pulley 104 connected to a DC variable speed motor 106, and imparts an additive speed to the output sprocket 98. The DC motor 106, in the forward direction, adds to the output of sprocket 98 a proportional speed increase as determined by the predetermined speed output of motor 106. In the reverse direction, motor 106 imparts a subtractive speed output to the rotation of shaft 98 in a conventional manner.

There is a transmission means in the form of chain 108 connected to main output 98 which drive a second sprocket 110 connected to shaft 112. Power is taken off shaft 12 by means of sprocket 114. sprocket 114 is connected by a chain 116 to a sprocket 118 which is affixed to shaft 56 of feed roll 54. Drive chain 116 is also connected to a sprocket 120 affixed to a shaft 122 to drive a second feed roll 124. There is an idler feed roll 126 also about which the fabric travels and is delivered to the entry end of the tenter. Bowed roll 127 expands the fabric laterally so that it may be more evenly spread.

Normally, the main feed roll will be driven in synchronization and at the same speed as the tenter. The conveyors C will also be driven in synchronization with the tenter chain by virtue of the mechanical drive connection provided between chain 50, sprocket 46 and main input 92 of phase adjusting drive 94.

Continuing to refer to FIG. 4, it can be seen that there is a first output sprocket 128 on shaft 112 by which power is taken off and transferred by a chain 129 and sprocket 130 to provide a first input means. There is a first secondary phase adjusting drive means D designated generally as 132 connected to input 130. Phase adjusting drive 132 may be identical to the phase adjusting drive means 94. There is a first output means for drive means 132 in the form of a sprocket 134 which is connected by a drive chain 136 to a sprocket 138 on a shaft 140 to which gear drive pulley 42 is affixed. Fabric conveyor C is driven by first phase adjusting drive means 132.

It will be noted that shaft 112 continues to the other side of the entry end and has affixed thereto a sprocket 142 which drives a drive chain 144 which in turn drives a sprocket 146. Sprocket 146 provides a second input for a second secondary phase adjusting drive means D designated generally as 150. There is a second output 152 from drive means 150 which drives a sprocket 154 by a chain 156. Sprocket 154 is affixed to shaft 148 to which drive gear pulley 42 is affixed for driving the opposing conveyor C.

The electric motors of the phase adjusting drivers 94, 132, 150 may be controlled manually by remote control buttons to change the phase (spaed) of the drive in additive or subtractive manner. Of course, automatic control may also be provided.

As long as there is no need to shift the speed of either conveyor C to correct for distortion of the fabric, the conveyors C will each be driven at the same speed and will be driven by main output 98 of main phase adjusting drive means 94. The mechanical drive arrangement consisting of the various elements, i.e. sprockets, chains, gears, belts, etc., between tenter chain sprocket 46 and gear pullys 42 driving conveyors C is sized so that normally the conveyors C are precisely driven in 1:1 ratio with the tenter, i.e. tenter chains 50. Normal operation means the phase adjusting drive means (94, 132, 150) are in a non-actuated mode; and no additive or subtractive adjustment is being made for overfeed or underfeed, respectively.

The phase adjusting drive means may drive the conveyors in an overfeed or underfeed mode as the need be in order to maintain the weight of the fabric per yard in accordance with fabric specifications. In the case of the fabric being overweight, underfeeding of the fabric by the conveyors is accomplished. The conveyor belts are slowed down more than the chain and stretching occurs between the fabric and the tenter chain.

The fabric may also be stretched by keeping the phase adjusting drive means 94 the same and energizing the phase adjusting drives 132, 150 for the conveyors so that stretch occurs between the main feed roll and the catching end of the conveyors adjacent thereto.

In the case of underweight fabric, overfeed of the fabric occurs at the entry end whereby more fabric is placed on the tenter chains which is subsequently delivered to the oven to condense the fabric and add weight to the output.

Referring now to FIG. 7, there is illustrated an embodiment of the invention which may be utilized with a tenter clip chain instead of a tenter pin chain as previously disclosed. In the embodiment of FIG. 7, there is horizontally traveling chain 160 carried about an idler sprocket 162 having a plurality of fabric clips 164 carried thereon in a conventional manner. However, in this case, there is a pair of fixed parallel clipping rail sections E which may be mounted on carriage 41 to slide in a parallel in a conventional manner. However, the clipping rail sections E do not move longitudinally and, as illustrated, are thus brought very closely to the main feed roll 54. In this manner, positive control over the fabric as it is clipped may be made since the distance between the feed roll and fixed clipping rail section is minimized. Moveover, the fabric may be clipped in a parallel manner by the clips 160 owing to the parallel relationship of the opposing clipping rail sections E.

While preferred embodiments of the invention have been described using specific terms, such description is for illustrative purposes only, and it is to be understood that changes and variations may be made without departing from the spirit or scope of the following claims.

What I claim is:

1. A tenter entry feed system for a tenter of the type which includes a pair of tenter rails, a pair of entry rails connected to said tenter rails, tenter chains carried for traveling movement about said rails having a plurality of tenter pins for pinning a fabric to said chains for delivery of said fabric through said tenter, said tenter entry feed system comprising:

a frame;

a main fabric feed roll;

drive means for driving said main fabric feed roll;

a first entry feed assembly slideably carried adjacent one side of said frame, and a second entry feed assembly slideably carried adjacent an opposing side of said frame, means for slideably carrying said first and second assemblies for lateral movement towards and away from each other in a parallel manner to follow the fabric selvages and for fixing said first and second assemblies against movement in a longitudinal direction in which fabric travels, and means for moving said first and second assemblies in response to a fabric selvedge position; and each said entry feed assembly including:

a parallel pinning rail section affixed to said entry feed assembly for parallel lateral movement and fixed against longitudinal movement with respect to said entry feed assembly, an idler sprocket with said tenter pin chain traveling about said sprocket along an associated parallel pinning rail section, elongated fabric conveyor means carried adjacent said parallel pinning rail section and tenter pin chain for positively conveying fabric through said entry feed assembly, conveyor drive means for driving said elongated fabric conveyor means to control overfeed and underfeed of fabric to said tenter, feed plate means carried adjacent said elongated fabric conveyor means, and overfeed wheel means carried in superposed relationship with said elongated fabric conveyor means including means for pinning fabric onto said pins of said tenter pin chain at a pinning point while said fabric is conveyed by said elongated conveyor means

2. The apparatus of claim 1 wherein opposing ends of said parallel pinning rail sections are fixed on said entry feed assembly against movement in a longitudinal direction of fabric travel.

3. The apparatus of claim 1 including a pinning zone along each said parallel pinning rail section over which said fabric is positively conveyed in a relaxed state for pinning, said pinning zone being generally defined from said idler sprocket, said pinning point, and a substantial distance forward of said pinning point in the direction of fabric travel defined by a pinning wheel.

4. The apparatus of claim 1 wherein each said elongated conveyor means extends a substantial distance rearwardly of said pinning point to positively convey fabric in laid-out relaxed manner prior to said pinning point.

5. The apparatus of claim 1 wherein each said elongated conveyor means extends rearwardly in close proximity to said main feed roll conveying said fabric to said entry system so that the span of fabric between said feed roll and said pinning point is minimized in a manner that positive control over the fabric may be had without wandering of selvages prior to pinning at said pinning point.

6. The apparatus of claim 5 further including a guard plate carried in a gap between said main feed roll and said chain sprockets for protecting said fabric from soiling due to the close proximity of said main feed roll and chain sprockets.

7. The apparatus of claim 1 wherein each said feed plate means includes a downwardly curved contour which terminates in a generally level contour at said pinning point, said downwardly curved contour guiding said fabric downwardly to said pinning point while said pins of said tenter pin chain are moving in an upwards direction in a manner that said fabric mates with said pins while said pins are moving upwards and said fabric is moving downwards, and said overfeed wheel means engages said fabric at the transition of said feed plate means from said curved to said level contour.

8. The apparatus of claim 1 wherein each said pinning means includes a pinning brush carried concentrically with said wheel means in a manner that said pinning brush aids the pinning of said fabric at said pinning point while said fabric is conveyed between said overfeed wheel means and said elongated conveyor means at said pinning point.

9. A tenter entry feed system for a tenter of the type which includes a pair of spaced tenter rails, spaced entry rails pivotally connected to said tenter rails, a tenter chain carried for traveling movement on each said tenter rail and entry rail having a plurality of tenter pins for pinning a fabric to said chains for delivery through said tenter, a drive for the tenter chains, a main feed roll for delivering fabric to said entry feed system, wherein said entry feed system comprises:

a frame;

a first entry feed assembly carried on one side of said frame in a slidable manner;

a second entry feed assembly carried on an opposing side of said frame in a slidable manner;

means for slideably carrying said first and second feed assemblies on said frame in a parallel manner, and means for sensing a width of said fabric to adjust the spacing between said first and second feed assemblies to follow the width of the fabric traveling between said first and second feed assemblies;

a first parallel pinning rail section carried by said first entry feed assembly over which an associated tenter chain travels;

a first elongated fabric conveyor means carried adjacent to and extending along length of said first parallel pinning rail section;

a second parallel pinning rail section included in said second entry feed assembly along which an associated tenter chain travels;

a second elongated fabric conveyor means carried adjacent to and along a length of said second parallel pinning rail section;

conveyor drive means for driving said elongated fabric conveyors to control overfeed and underfeed of fabric to said tenter;

a chain idler sprocket driven by said tenter pin chains carried by each of said first and second entry feed assemblies and at least one of said idler sprockets being mechanically connected to said conveyor drive means so that a mechanical interlock is provided between said fabric feed and said tenter chain drive; and said first and second pinning rail sections being carried parallel to one another with opposing ends fixed against angular and longitudinal movement, and said first and second elongated fabric conveyor means being carried parallel to one another and to said pinning rail sections.

10. The apparatus of claim 9 wherein said conveyor drive means includes phase adjusting drive means connected to the drive of said tenter chains for driving said first and second fabric conveyor means in direct synchronization with said tenter.

11. The apparatus of claim 10 wherein said phase adjusting drive means is mechanically connected to said tenter chain drive in a manner to form a mechanical interlock for positive synchronization.

12. The apparatus of claim 10 wherein said phase adjusting drive means comprises a main phase adjusting drive means mechanically connected to said tenter chain drive, a first phase adjusting drive means mechanically connected to a main output of said main phase adjusting drive means for driving said first fabric conveyor means, and a second phase adjusting drive means mechanically connected to said main output of said main phase adjusting drive means for driving said second fabric conveyor means.

13. The apparatus of claim 12 including control means for controlling said main phase adjusting drive means, first phase adjusting drive means, and second phase adjusting drive means individually to drive said first and second fabric conveyor means 1:1 with said tenter, and said first and second phase adjusting drives may modify said main output to drive said first and second fabric conveyor means at modified speeds individually.

14. The apparatus of claim 10 wherein said phase adjusting drive means has a main output for driving said first and second fabric conveyors and includes an electrical D.C. motor, and a phase adjusting gear drive box having an input connected to said D.C. motor, said D.C. motor being positively driven in a forward or reverse direction to respectively and proportionately add to or subtract from said input to provide a respectively increased or decreased output at said main output.

15. A tenter entry feed system for a tenter of the type which includes a pair of spaced tenter rails, spaced entry rails pivotally connected to said tenter rails, a tenter chain carried for traveling movement on each said tenter rail and entry rail having a plurality of tenter pins for pinning a fabric to said chains for delivery through said tenter, a main feed roll for delivering fabric to said entry system, wherein said entry feed system comprises:

a frame;

a first entry feed assembly carried on one side of said frame in a slideable manner;

a second entry feed assembly carried on an opposing side of said frame in a slideable manner;

means for slideably carrying said first and second feed assemblies on said frame in a parallel manner, and means for sensing a width of said fabric to adjust the spacing between said first and second feed assemblies to follow the width of the fabric traveling between said first and second feed assemblies;

a first parallel pinning rail section carried by said first entry feed assembly along which an associated tenter chain travels;

a first elongated fabric conveyor means carried adjacent to and extending along a length of said first parallel pinning rail section;

a second parallel pinning rail section included in said second entry feed assembly along which an associated tenter chain travels;

a second elongated fabric conveyor means carried adjacent to and along a length of said second parallel pinning rail section;

said first and second pinning rail sections being carried parallel to one another, and said first and second elongated fabric conveyors being carried parallel to one another;

a chain idler sprocket driven by said tenter pin chains carried by each of said first and second entry feed assemblies;

main phase adjusting drive means mechanically interlocked with said driven tenter chain for adjusting the speed of said first and second elongated fabric conveyors in synchronization with the speed of said tenter;

said main phase adjusting drive means having a main input connected to a take-off of one of said chain sprockets, and said main phase adjusting drive means having a main output;

a first phase adjusting drive means having an input connected to said main output, said first phase adjusting drive having a first output connected to said first fabric conveyor means for driving said first fabric conveyor means;

a second phase adjusting drive means having a second input connected to said main output, and said second phase adjusting drive means having a second output connected to said second fabric conveyor means for driving said second fabric conveyor means;

said main phase adjusting drive means receiving the speed of said tenter chain at said main input and producing a modified output at said main output to control the overfeed and underfeed of said fabric conveyed by said first and second elongated conveyor means;

said first and second phase adjusting drive means receiving said main output to selectively drive said first and second fabric conveyor means in a 1:1 ratio with said main output; and said first and second phase adjusting drive means being selectively operable to modify said main output of said main phase adjusting drive to selectively drive said first and second fabric conveyors at different speeds in relation to said speed of said tenter chain to correct for skew and bias in said fabric.

16. The apparatus of claim 15 including feed roll drive means for driving said main feed roll in response to said main output of said main phase adjusting drive means.

17. The apparatus of claim 15 wherein said main phase adjusting drive means includes a planetary gear arrangement connected to said main input and main output, and a controlable variable speed D.C. motor which may control said planetary gear arrangement to add to and subtract from the main input to produce said main output.

18. The apparatus of claim 15 wherein said chain sprocket takeoff includes a takeoff shaft connected to said chain sprocket having a first gear belt pulley affixed thereto, said main input includes a second gear belt pulley connected to said first gear belt pulley by a first gear belt.

19. The apparatus of claim 15 wherein said first input of said first phase adjusting drive means and said second input of said second phase adjusting drive means include a common input shaft connected to both said first and second inputs, and transmission means connecting and driving said common shaft by said main output.

20. The apparatus of claim 15 wherein said first and second outputs of said respective first and second phase adjusting drive means include first and second split individual drive shafts, a drive gear belt pulley affixed to each of said first and second drive shafts, said first and second drive shafts being operatively connected and driven by said first and second output means, respectively, and said elongated conveyor means comprising elongated conveyor belts meshing with said gear belt pulleys in a manner that said first and second conveyor belts are driven by said respective first and second outputs.

21. The apparatus of claim 15 wherein said first and second fabric conveyor means each include an elongated conveyor belt transporting said fabric and being positively driven by said first and second outputs, and each said elongated conveyor belt extends in close proximity to said main feed roll well behind a pinning point at which said fabric is initially pinned to said tenter pins so that positive control of said fabric spanning from said main feed roll to said pinning point is had.

22. A method of attaching fabric at pinning points to tenter pin chains traveling upon the tenter rails of a tenter in a manner that uniform stretching of the filling yarns occurs and curled selvedges of the fabric and skew and bias lines in the fabric are reduced comprising:

providing a pair of spaced-apart entry feed assemblies at the entry end of said tenter which are slideably carried on a frame in a parallel manner;

including in each of said entry feed assemblies a parallel pinning rail section feeding an associated entry rail and an elongated parallel fabric conveyor extending adjacent a length of each said parallel pinning rail section;

pinning fabric onto said pins of an associated tenter pin chain at a pinning point in a relaxed state generally without tension;

laying said fabric out on said fabric conveyors in said relaxed state in advance of said pinning points and positively conveying said fabric in said relaxed state to said pinning point on each of said parallel pinning rail sections;

moving said first and second feed assemblies parallel towards and away from each other in response to a width of said fabric to generally follow said fabric width;

fixing the ends of said parallel pinning rail sections closely adjacent a main feed roll delivering said fabric to said entry feed assemblies in a manner that the span of said fabric from said feed roll to said pinning point is minimized;

conveying said fabric generally from said feed roll to said pinning points by said fabric conveyors by reducing the distance between said feed roll to said pinning point so that positive control is had over said fabric without wandering of the edges so that said fabric may be laid upon said tenter chain pins at said pinning points in a relaxed tension-free manner with the edges straight and parallel on said pins;

driving said fabric covneyors at a speed to control the underfeed and overfeed of fabric to said tenter;

adjusting the speed of said fabric conveyors in synchronization with the speed of said tenter pin chains to feed the fabric as is necessary to control the fabric weight from said tenter in a highly accurate manner; and adjusting the speed of said elongated fabric conveyors individually to accurately and positively control the speeds of the opposing selvages of said fabric independently to correct for skew and bias in said fabric.

23. The method of claim 22 including providing said elongated fabric conveyors in the form of elongated traveling conveyor belts which contact and transport said fabric over a substantial length of said parallel pinning rail sections to positively control and convey the fabric through said pinning rail sections.

24. A method of attaching fabric to tenter pin chains of a tenter in a manner that the fabric weight output from the tenter and fabric distortion may be controlled and minimized, comprising the steps of:

providing a pair of spaced apart carriages which slide on a frame at the entry end of the tenter;

affixing a parallel pinning rail section having an entry end to each carriage in a manner that said rail sections move laterally toward and away from each other in a parallel relation with their entry ends fixed against longitudinal movement in the direction of fabric travel;

moving said first and second feed rail sections parallel towards and away from each other in response to a width of said fabric to generally follow said fabric width;

maintaining said fixed entry ends of said parallel rail sections fixed against said longitudinal movement so that said entry ends are arranged closely adjacent a main feed roll which feeds fabrics onto said chains which travel about said parallel rail sections;

positively controlling the transport of the fabric from the feed roll to attachment points on said traveling tenter chains which points are in close proximity to said main feed roll thereby minimizing the distance between said attachment points and main feed roll so that positive control over the transportation of the fabric from the feed roll to the attachment points is maintained without wandering of the selvages of the fabric and the selvages of the fabric may be attached in a straight parallel manner to said tenter chains to thereby reduce fabric skew lines and fabric distortion; and maintaining a distance from said main feed roll to said fabric attachment points constant as said fabric is transported to said attachment points.

25. Tenter entry feed apparatus for attaching fabric selvages to traveling tenter chains which travel over tenter rails comprising:

a frame;

a main feed roll carried adjacent said frame;

a pair of parallel attachment rail sections about which said tenter chains travel;

means for carrying said parallel attachment rail sections on said frame in a manner that said rail sections move towards and away from each other in a parallel relationship transverse to the direction of fabric travel and in which their ends are fixed in angular and longitudinal movement in relation to fabric travel;

means for moving said rail sections in response to a width of said fabric to follow said fabric width;

an entry end of each of said attachment rail sections being fixed closely adjacent said main feed roll and defining an attachment point for the attachment of said fabric to an associated tenter chain traveling about each said attachment rail section;

said entry end of each of said attachment rail sections being fixed against angular and longitudinal movement in close proximity to said main feed roll in a manner that the distance of the span of fabric between said main feed roll and attachment point is minimized; means for positively controlling the transport of the fabrics without wandering of the selvages from the main feed roll directly to said attachment points whereby straight and parallel attachment of the selvages to said tenter chains may be had and a constant fabric attachment point being defined by a distance between said main feed roll and said fabric attachment points which remains constant as said fabric is transported to said attachment points.

26. A tenter entry feed system for a tenter of the type which includes a pair of tenter rails, a pair of entry rails connected to said tenter rails, tenter chains carried for traveling movement about said rails having a plurality of tenter pins for pinning a fabric to said chains for delivery of said fabric through said tenter, said tenter entry feed system comprising:

a frame;

a main fabric feed roll;

drive means for driving said main fabric feed roll;

a first entry feed assembly slideably carried adjacent one side of said frame, and a second entry feed assembly slideably carried adjacent an opposing side of said frame, means for slidably carrying said first and second assemblies for movement towards and away from each other in a parallel manner to follow the fabric selvages, and means for moving said first and second assemblies in response to a fabric selvedge position; and each said entry feed assembly including:

a parallel pinning rail section affixed to said entry feed assembly for parallel movement therewith, an idler sprocket with an associated tenter pin chain traveling about said sprocket along said parallel pinning rail section, elongated fabric conveyor means carried adjacent said parallel pinning rail section and tenter pin chain for positively conveying fabric through said entry feed assembly, conveyor drive means for driving said elongated fabric conveyor means to control overfeed and underfeed of fabric to said tenter, overfeed wheel means carried in superposed relationship with said elongated fabric conveyor means including means for pinning fabric onto said pins of said tenter pin chain at a pinning point while said fabric is conveyed by said elongated conveyor means; and said elongated fabric conveyor means extending rearwardly from said overfeed wheel means to close proximity with said main fabric feed roll to generally span the entire distance therebetween and positively feed and control the fabric between said feed roll and a nip of said overfeed wheel means and said fabric conveyor means.

* * * * *